US008725016B2

(12) United States Patent
Nagayama

(10) Patent No.: US 8,725,016 B2
(45) Date of Patent: May 13, 2014

(54) HIGH SPEED IMAGE FORMING APPARATUS AND IMAGE FORMING METHOD THEREOF

(75) Inventor: Katsuhiro Nagayama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 382 days.

(21) Appl. No.: 13/183,797

(22) Filed: Jul. 15, 2011

(65) Prior Publication Data

US 2012/0020687 A1 Jan. 26, 2012

(30) Foreign Application Priority Data

Jul. 23, 2010 (JP) ..... 2010-166083

(51) Int. Cl.
*G03G 15/00* (2006.01)
*G03G 15/01* (2006.01)

(52) U.S. Cl.
USPC ..... 399/49; 399/301

(58) Field of Classification Search
USPC ..... 399/49, 301
See application file for complete search history.

(56) References Cited

U.S. PATENT DOCUMENTS

| | | | | |
|---|---|---|---|---|
| 5,581,327 | A | 12/1996 | Izumizaki et al. | |
| 2001/0031148 | A1* | 10/2001 | Kajiwara et al. | 399/49 |
| 2006/0024076 | A1* | 2/2006 | Kato et al. | 399/49 |
| 2007/0217801 | A1* | 9/2007 | Tsuboi et al. | 399/49 |
| 2007/0230979 | A1 | 10/2007 | Hasegawa et al. | |
| 2007/0237531 | A1 | 10/2007 | Maebashi | |
| 2007/0242965 | A1* | 10/2007 | Akamatsu | 399/49 |
| 2009/0033993 | A1 | 2/2009 | Nakazato et al. | |
| 2009/0245822 | A1 | 10/2009 | Nagatsuka et al. | |
| 2010/0003041 | A1 | 1/2010 | Otsuka | |

FOREIGN PATENT DOCUMENTS

| | | | |
|---|---|---|---|
| JP | 7-234557 | A | 9/1995 |
| JP | 2005-084543 | A | 3/2005 |
| JP | 2006-047779 | A | 2/2006 |
| JP | 2006-220848 | A | 8/2006 |
| JP | 2007-256522 | A | 10/2007 |
| JP | 2007-279429 | A | 10/2007 |
| JP | 2007-292855 | A | 11/2007 |
| JP | 2008-276142 | A | 11/2008 |
| JP | 2009-128636 | A | 6/2009 |
| JP | 2009-229958 | A | 10/2009 |
| JP | 2010-14898 | A | 1/2010 |

* cited by examiner

*Primary Examiner* — Walter L Lindsay, Jr.
*Assistant Examiner* — Rodney Bonnette
(74) *Attorney, Agent, or Firm* — Renner, Otto, Boisselle & Sklar, LLP

(57) ABSTRACT

An image forming apparatus includes image forming sections for respective colors, the image forming sections facing an outer surface of an intermediate transfer belt on an outward path. A transfer roller is provided on a returning path and is movable to a contact position where the transfer roller is pressed against the intermediate transfer belt or to a detachment position where the transfer roller is detached from the intermediate transfer belt. A density sensor is provided for detecting a density of toner image on the intermediate transfer belt. In an image quality adjustment operation, image forming sections form a toner image row on the intermediate transfer belt, and the density sensor measures densities. A length of the toner image row is smaller than a length of the intermediate transfer belt between the endmost photoreceptor drum on the downstream side and the transfer roller.

7 Claims, 11 Drawing Sheets

| | SPEED [mm/sec] | PATCH TIME [sec] |
|---|---|---|
| A4 10-SHEET APPARATUS | 39.5 | 8.10 |
| A4 20-SHEET APPARATUS | 79.5 | 4.03 |
| A4 30-SHEET APPARATUS | 119.5 | 2.68 |
| A4 40-SHEET APPARATUS | 159.5 | 2.01 |
| A4 50-SHEET APPARATUS | 199.5 | 1.60 |

CONDITIONS:
TOTAL LENGTH OF PATCH = 320mm
DISTANCE FROM K DRUM TO SECOND TRANSFER SECTION = 400mm

CONDITIONS:
TOTAL LENGTH OF PATCH = 320mm
DISTANCE FROM K DRUM TO SECOND TRANSFER SECTION = 200mm

FIG. 12

| | SPEED [mm/sec] | CONVENTIONAL TIME [sec] | TIME OF PRESENT INVENTION [sec] |
|---|---|---|---|
| A4 10-SHEET APPARATUS | 39.5 | 13.16 | 0.51 |
| A4 20-SHEET APPARATUS | 79.5 | 6.54 | 0.25 |
| A4 30-SHEET APPARATUS | 119.5 | 4.35 | 0.17 |
| A4 40-SHEET APPARATUS | 159.5 | 3.26 | 0.13 |
| A4 50-SHEET APPARATUS | 199.5 | 2.61 | 0.10 |

HIGH SPEED IMAGE FORMING APPARATUS AND IMAGE FORMING METHOD THEREOF

This Nonprovisional application claims priority under 35 U.S.C. §119(a) on Patent Application No. 2010-166083 filed in Japan on Jul. 23, 2010, the entire contents of which are hereby incorporated by reference.

TECHNICAL FIELD

The present invention relates to (i) an image forming apparatus which includes an intermediate transfer belt and forms, on the intermediate transfer belt in process control, a toner patch for image quality adjustment and to (ii) an image forming method which is used by the image forming apparatus.

BACKGROUND ART

An electrophotographic image forming apparatus having an intermediate transfer belt forms an electrostatic latent image on a photoreceptor, then develops a toner image from the electrostatic latent image by use of toners, then transfers the toner image onto the intermediate transfer belt, then further transfers the toner image onto a sheet of recording paper, and finally fixes the toner image onto the sheet of recording paper.

Such transfer of a toner image from the intermediate transfer belt onto a sheet of recording paper is carried out by a second transfer section in which second transfer rollers faces each other across the intermediate transfer belt. Specifically, the second transfer rollers are provided so as to detach from and come into contact with the intermediate transfer belt. The transfer of a toner image is carried out in such a manner that while the second transfer rollers are pressed against the intermediate transfer belt, a sheet of recording paper is carried therebetween so that a bias voltage which causes the toner image to be transferred from the intermediate transfer belt to the sheet of recording paper is applied to the second transfer rollers.

As shown in Patent Literatures 1 and 2, a charging characteristic etc. of the photoreceptor of such an image forming apparatus are changed due to changes of environmental conditions such as temperature and humidity. As a result, an image quality are changed. In view of this, an image forming apparatus carries out process control for image quality adjustment, e.g., every time printing is carried out with respect to a predetermined number of sheets of recording paper, or in accordance with changes of environmental conditions such as temperature and humidity.

In the process control, first, many small toner images (hereinafter, referred to as toner patches) are formed in a line so as to have gradually-changed color densities, with respect to each of toners having respective colors. Then, the color densities of the toner patches on the intermediate transfer belt are measured by a density sensor. On the basis of the measurement result, a control process for image quality adjustment is carried out. In the process control, e.g., an applied voltage to be applied to a charger which charges the photoreceptor and an output value of an exposure light source which exposes the photoreceptor are controlled so that an image quality is adjusted.

CITATION LIST

Patent Literature 1

Japanese Patent Application Publication, Tokukai, No. 2010-014898 A (Publication Date: Jan. 21, 2010)

Patent Literature 2

Japanese Patent Application Publication, Tokukai, No. 2007-292855 A (Publication Date: Nov. 8, 2007)

Japanese Patent Application Publication, Tokukaihei, No. 7-234557 A (Publication Date: Sep. 5, 1995)

SUMMARY OF INVENTION

Technical Problem

In a case where a request to carry out process control arises in an image forming apparatus under instruction to execute a print job for printing, e.g., a plurality of sheets, the process control is carried out between printing on a sheet and printing on a next sheet. In this case, there is a wait time until the printing on the next sheet is started. In a case where the process control is carried out in a print job for printing a plurality of sheets for which print job an executive instruction has been issued, this decreases a processing speed of the print job as a whole.

In the process control, it is necessary to accurately form toner patches in rows on the intermediate transfer belt, read respective densities of the toner patches in the toner patch rows by a density sensor(s), and obtain accurate density information. For the sake of this, it is necessary to prevent the intermediate transfer belt from being shaken in the formation of the toner patch rows on the intermediate transfer belt.

In a case where the second transfer roller is detached from or brought into contact with the intermediate transfer belt, the intermediate transfer belt is shaken. Accordingly, it is impossible to detach the second transfer roller from or bring the second transfer roller into contact with the intermediate transfer belt, in the formation of the toner patch rows on the intermediate transfer belt. In this case, it is necessary to form the toner patches on the intermediate transfer belt after the second transfer roller is detached from the intermediate transfer belt in advance, depending on a relationship between (i) a length of the intermediate transfer belt between a second transfer section and an endmost photoreceptor on a downstream side with respect to a moving direction of the intermediate transfer belt and (ii) a length of each of the toner patch rows formed on the intermediate transfer belt. In this case, there is a problem in that a processing speed of a print job is considerably decreased.

According to Patent Literature 3, a time from the detachment of the first image carrier 1M and the transfer belt from each other to the arrival of a toner patch formed on the second image carrier 1K to a transfer position of the second image carrier 1K is arranged to be longer than L/v (sec), where L (mm) represents a distance between a first image carrier 1M on an upstream side with respect to a moving direction of a transfer belt and a second image carrier 1K on the downstream side thereof, and v (mm/sec) represents the moving speed of the transfer belt.

However, the invention disclosed in Patent Literature 3 is such that a sheet for recording paper is carried on the transfer belt, and stations corresponding to respective colors transfer toner images from photoreceptors to the sheet of recording paper. That is, the invention does not assume such an arrangement that the toner images are transferred from the photoreceptors to the intermediate transfer belt, and the toner images are further transferred in the second transfer section, by the second transfer roller, from the intermediate transfer belt onto the sheet of recording paper. Accordingly, the invention disclosed in Patent Literature 3 does not make it possible to solve the problem above. Further, according to the invention disclosed in Patent Literature 3, a moving speed of the transfer belt is variable. Accordingly, at least two speeds are required as a driving speed for the transfer belt. This leads to another problem in that a driving mechanism becomes complex and expensive.

In view of this, the present invention aims at provision of (i) an image forming apparatus which can suppress a decrease in processing speed of a print job even if process control is carried out at a certain point in the print job, and (i) an image forming method of the image forming apparatus.

Solution to Problem

In order to attain the object, an image forming apparatus of the present invention includes: an intermediate transfer belt being supported by a first roller and a second roller so as to be rotated in one direction, the intermediate transfer belt having, as a moving path of an outer surface of the intermediate transfer belt, an outward path extending from the first roller to the second roller and a returning path extending from the second roller to the first roller; image forming sections corresponding to respective colors, the image forming sections having respective photoreceptor drums which face the outer surface of the intermediate transfer belt on the outward path, the image forming sections forming respective toner images on the respective photoreceptor drums, the image forming sections being arranged in a direction in which the outward path extends; a transfer roller being provided in position on the returning path, the transfer roller which is moved to a contact position where the transfer roller is pressed against the outer surface of the intermediate transfer belt or to a detachment position where the transfer roller is detached from the outer surface; and at least one density sensor which measures a density of a toner image formed on the intermediate transfer belt, the at least one density sensor being provided between said transfer roller and an endmost one of the respective photoreceptor drums on a downstream side of the outward path; in a printing operation, the respective toner images formed on the respective photoreceptor drums being transferred onto the intermediate transfer belt so as to be superimposed, and while said transfer roller is in the contact position, a toner image thus formed on the intermediate transfer belt being transferred onto a sheet supplied between said transfer roller and the intermediate transfer belt, in an image quality adjustment operation, said image forming sections forming, on the intermediate transfer belt, at least one toner image row for image quality adjustment, the at least one toner image row being a row of toner images for image quality adjustment, and said at least one density sensor measuring a density of each of the toner images for image quality adjustment in the at least one toner image row, the at least one toner image row having a length smaller than a length of the intermediate transfer belt between said transfer roller and the endmost one of the respective photoreceptor drums on the downstream side of the outward path.

Further, an image forming method of the present invention for an image forming apparatus, the image forming apparatus including: an intermediate transfer belt being supported by a first roller and a second roller so as to be rotated in one direction, the intermediate transfer belt having, as a moving path of an outer surface of the intermediate transfer belt, an outward path extending from the first roller to the second roller and a returning path extending from the second roller to the first roller; image forming sections corresponding to respective colors, the image forming sections having respective photoreceptor drums which face the outer surface of the intermediate transfer belt on the outward path, the image forming sections forming respective toner images on the respective photoreceptor drums, the image forming sections being arranged in a direction in which the outward path extends; a transfer roller being provided in position on the returning path, the transfer roller which is moved to a contact position where the transfer roller is pressed against the outer surface of the intermediate transfer belt or to a detachment position where the transfer roller is detached from the outer surface; and at least one density sensor which measures a density of a toner image formed on the intermediate transfer belt, the at least one density sensor being provided between said transfer roller and an endmost one of the respective photoreceptor drums on a downstream side of the outward path; in a printing operation, the respective toner images formed on the respective photoreceptor drums being transferred onto the intermediate transfer belt so as to be superimposed, and while said transfer roller is in the contact position, a toner image thus formed on the intermediate transfer belt being transferred onto a sheet supplied between said transfer roller and the intermediate transfer belt, in an image quality adjustment operation, said image forming sections forming, on the intermediate transfer belt, at least one toner image row for image quality adjustment, the at least one toner image row being a row of toner images for image quality adjustment, and each of said at least one density sensor measuring a density of each of the toner images for image quality adjustment in the at least one toner image row, the image forming method includes the step of forming the at least one toner image row for image quality adjustment so that the at least one toner image row has a length smaller than a length of the intermediate transfer belt between said transfer roller and the endmost one of the respective photoreceptor drums on the downstream side of the outward path.

According to the arrangement, in a printing operation, toner images formed on the photoreceptor drums of the image forming sections are transferred onto the intermediate transfer belt so as to be superimposed, and while the transfer roller is in the contact position, the toner images on the intermediate transfer belt are transferred onto a sheet supplied between the transfer roller and the intermediate transfer roller. On the other hand, in an image quality adjustment operation, the image forming sections form, on the intermediate transfer belt, at least one toner image row for image quality adjustment, which toner image row is a row of toner images for image quality adjustment, and the at least one density sensor measures a density of each of the toner images for image quality adjustment in the at least one toner image row.

The at least one toner image row has a length smaller than a length of the intermediate transfer belt between the transfer roller and the endmost one of the respective photoreceptor drums on the downstream side of the outward path. Accordingly, in a case where the printing operation has been switched to the image quality adjustment operation at a certain point in a print job in response to a request for the image quality adjustment operation, and the at least one toner image row for image quality adjustment is formed on the intermediate transfer belt, the transfer roller can be held at the contact position where the transfer roller is pressed against the intermediate transfer belt. In other words, even if the transfer roller is held at the contact position, it is possible to complete the formation of the at least one toner image row for image quality adjustment on the intermediate transfer belt, until the at least one toner image row reaches the transfer roller having no cleaning mechanism.

Accordingly, there is no need to move the transfer roller from the intermediate transfer belt to the detachment position while the at least one toner image row for image quality adjustment is formed on the intermediate transfer belt, in order to prevent the transfer roller having no cleaning mechanism from having a toner blot. Even if the image quality adjustment operation is carried out at a certain point in a print job, there is no need to wait, before the image quality adjustment operation is carried out, for a time for (i) detaching the transfer roller from the intermediate transfer belt and (ii) dampening shaking of the intermediate transfer belt thus caused. This makes it possible to suppress a decrease in processing speed of a print job.

Advantageous Effects of Invention

As described above, according to the arrangement of the present invention, in a case where the printing operation has been switched to the image quality adjustment operation at a certain point in a print job in response to a request for the image quality adjustment operation, and the at least one toner image row for image quality adjustment is formed on the intermediate transfer belt, the transfer roller can be held at the contact position where the transfer roller is pressed against the intermediate transfer belt. In other words, even if the transfer roller is held at the contact position, it is possible to complete the formation of the at least one toner image row for image quality adjustment on the intermediate transfer belt, until the at least one toner image row reaches the transfer roller having no cleaning mechanism.

Accordingly, there is no need to move the transfer roller from the intermediate transfer belt to the detachment position while the at least one toner image row for image quality adjustment is formed on the intermediate transfer belt, in order to prevent the transfer roller having no cleaning mechanism from having a toner blot. Even if the image quality adjustment operation is carried out at a certain point in a print job, there is no need to wait, before the image quality adjustment operation is carried out, for a time for (i) detaching the transfer roller from the intermediate transfer belt and (ii) dampening shaking of the intermediate transfer belt thus caused. This makes it possible to suppress a decrease in processing speed of a print job.

BRIEF DESCRIPTION OF DRAWINGS

FIG. 2(*b*) is an explanatory view illustrating a positional relationship between the second transfer roller and a second transfer roller supporting member in a state illustrated in FIG. 2(*a*).

FIG. 3(*b*) is an explanatory view illustrating a positional relationship between the second transfer roller and the second transfer roller supporting member in a state illustrated in FIG. 3(*a*).

FIG. 10(*b*) is an explanatory view illustrating a positional relationship between the photoreceptor drums and the second transfer section (second transfer roller) in the image forming apparatus of FIG. 1.

FIG. 11(*b*) is an explanatory view illustrating a positional relationship between the photoreceptor drums and the second transfer section (second transfer roller) in the conventional image forming apparatus.

FIG. 12 is an explanatory view showing times for transition from a print job to toner patch row formation in a plurality of image forming apparatuses which differ in printing speeds.

DESCRIPTION OF EMBODIMENTS

The following describes an embodiment of the present invention, with reference to drawings.

Figure 1:
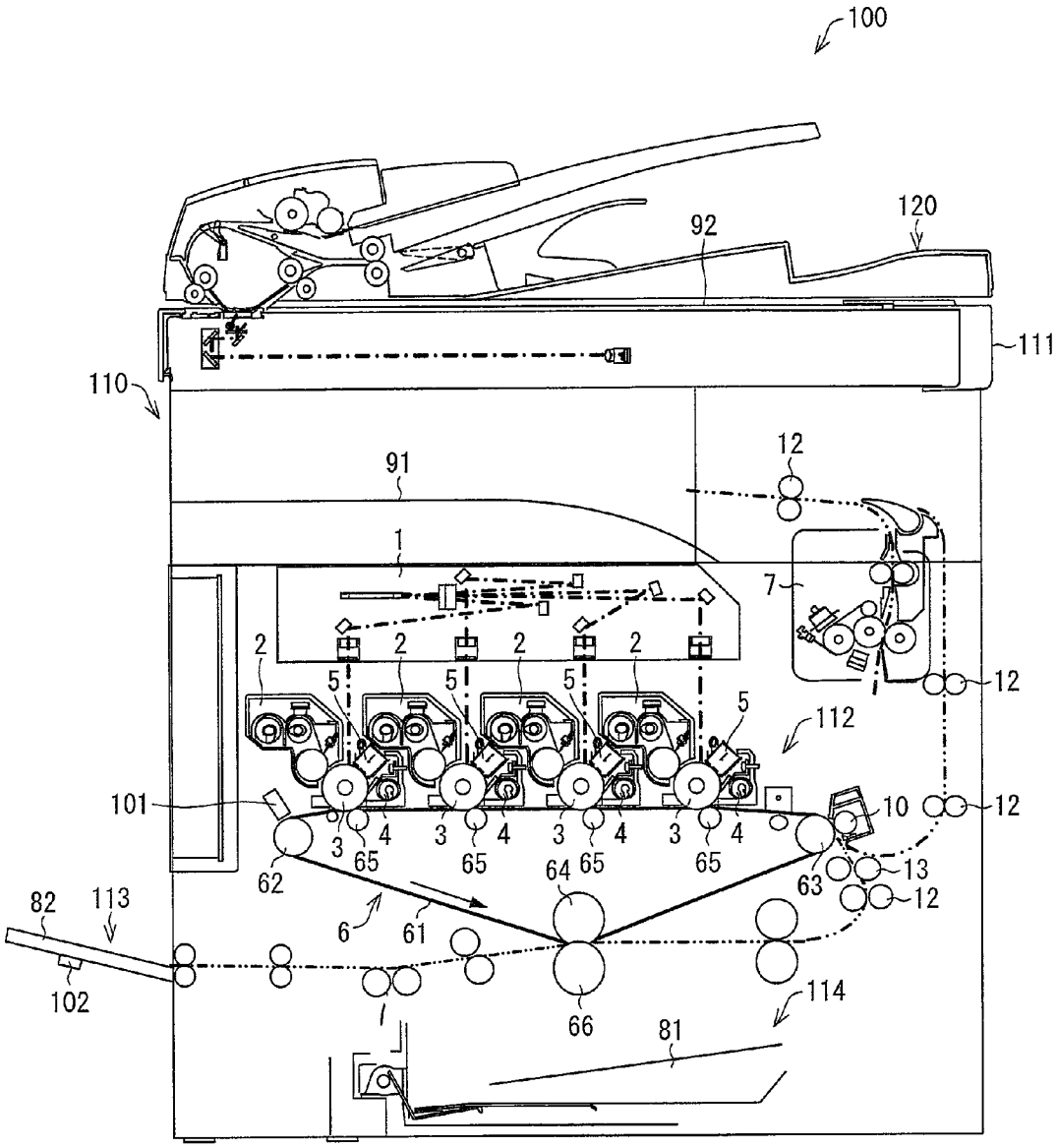
FIG. 1 is a vertical cross-sectional view illustrating an arrangement of an image forming apparatus of the present embodiment.

FIG. 1 is a vertical cross-sectional view illustrating an arrangement of an image forming apparatus of the present embodiment.

As illustrated in FIG. 1, an image forming apparatus 100 includes a main apparatus 110 and an automatic document feeder 120. The image forming apparatus 100 forms a multicolor or monochromatic image on a predetermined sheet (sheet of recording paper) in accordance with image data. The image data is externally supplied to the image forming apparatus 100 or is obtained by a document reading function of the image forming apparatus 100.

A scanner platen 92 made from transparent glass on which scanner platen 92 a document is placed is provided on an upper surface of the main apparatus 110. The automatic document feeder 120 is attached onto the scanner platen 92. The automatic document feeder 120 automatically carries, onto the scanner platen 92, a document set on a tray.

The main apparatus 110 includes a document reading section 111, a paper output tray 91, a fixing unit 7, an exposure unit 1, image forming sections 112, an intermediate transfer belt unit 6, a manual paper feeding section 113, and an internal paper feeding section 114, in this order downward from under the scanner platen 92.

The document reading section 111 reads an image on a document placed on the scanner platen 92 so as to obtain image data.

Image data to be handled by the image forming apparatus 100 corresponds to a color image in which the following four colors, black (K), cyan (C), magenta (M), and yellow (Y), are used. Accordingly, four image forming sections 112 are provided in the image forming apparatus 100 so as to correspond to the respective four colors. The four image forming sections 112 are image stations which correspond to the respective four colors. The four image forming sections 112 are provided in the following order, yellow→magenta→cyan→black, in a moving direction of the intermediate transfer belt 61.

Each of the four image forming sections 112 includes a developing device 2, a photoreceptor drum 3, a charger 5, and a cleaner unit 4.

The charger 5 is a means for uniformly charging a surface of the photoreceptor drum 3 so that the surface has a predetermined electric potential. Other than chargers 5 of an electrostatic charging type which are illustrated in FIG. 1, charging rollers of a contact-type or charging brushes of a contact-type can be employed.

The exposure unit 1 is a laser scanning unit (LSU) which includes a laser emitting section, reflection mirrors, etc. The exposure unit 1 includes polygon mirrors for scanning with the use of laser beams, and optical components such as lenses and mirrors for directing, to the photoreceptor drums 3, the laser beams reflected by the polygon mirrors. Instead, an EL or LED writing head in which light-emitting elements are provided in an array manner can be employed as the exposure unit 1.

The exposure unit 1 carries out exposure with respect to a surface of a photoreceptor drum 3 which is electrically charged, in accordance with supplied image data, thereby forming an electrostatic latent image on the surface of the photoreceptor drum 3 in accordance with the supplied image data. A developing device 2 visualizes, by use of toners, an electrostatic latent image formed on a surface of a photoreceptor drum 3. A cleaner unit 4 removes and collects a toner remaining on a surface of a photoreceptor drum 3 after development and image transfer are carried out.

The intermediate transfer belt unit 6 includes the intermediate transfer belt 61, an intermediate transfer belt driving roller (second roller) 62, an intermediate transfer belt driven roller (first roller) 63, an intermediate transfer tension roller 64, intermediate transfer rollers (first transfer rollers) 65, a second transfer roller (transfer roller) 66, and a belt cleaning unit 10. As the intermediate transfer rollers 65, four intermediate transfer rollers 65 are provided so as to correspond to the respective four image forming sections 112.

The intermediate transfer belt driving roller 62, the intermediate transfer belt driven roller 63, the intermediate transfer tension roller 64, and the intermediate transfer rollers 65 support the intermediate transfer belt 61 in a tensioned state so as to rotate the intermediate transfer belt 61. The intermediate transfer rollers 65 apply, to the intermediate transfer belt 61, transfer bias voltages for transferring toner images formed on the photoreceptor drums 3 onto the intermediate transfer belt 61.

The intermediate transfer belt 61 is provided so as to come into contact with the photoreceptor drums 3. Four toner images having respective colors, which are formed on the photoreceptor drums 3, are sequentially transferred onto the intermediate transfer belt 61 in a superimposed manner. Thus, a multicolor toner image is formed on the intermediate transfer belt 61.

The intermediate transfer belt 61 has a thickness from, e.g., approximately 50 μm to approximately 150 μm. The intermediate transfer belt 61 is an endless belt made up of a resin film made from polyimide or the like which resin film is a base material, and an elastic layer formed on the base material. The base material is, e.g., a semiconducting polyimide film having a thickness of 80 μm, and has a volume resistivity of $10^{10}$ Ω·cm and a surface resistivity of $10^{10}$ Ω·cm. The elastic layer is made from a chloroprene rubber, a urethane rubber, or the like, and has a thickness from 100 μm to 300 μm. In a case where the elastic layer has a thickness of less than 100 μm, the elastic layer is likely to be deformed and is inferior in elasticity. Such an elastic layer is inferior in close contact with the photoreceptor drums 3, and cannot conform to irregularities on a sheet of recording paper. As a result, transfer cannot be carried out appropriately. On the other hand, in a case where the elastic layer has a thickness of more than 300 μm, a peripheral velocity of the intermediate transfer belt 61 is affected so that a balance is deteriorated between a peripheral velocity of linear movement of the intermediate transfer belt 61 and a peripheral velocity of curved movement of the intermediate transfer belt 61 along a curved surface of a supporting roller. This results in displacement of a transferred image and a failure in carrying of a sheet of recording paper. The surface of the elastic layer can be coated with PTFE (Teflon).

The transfer of toner images from the photoreceptor drums 3 onto the intermediate transfer belt 61 is carried out by the intermediate transfer rollers 65 which are in contact with a back side of the intermediate transfer belt 61. In order that the toner images are transferred from the photoreceptor drums 3 to the intermediate transfer belt 61, transfer bias voltages which are high voltages (high voltages having a polarity (+) opposite to a polarity (−) of the toners) are applied to the intermediate transfer rollers 65. Each of the intermediate transfer rollers 65 is made up of a metal (e.g., stainless steel) shaft having a diameter from 8 mm to 10 mm, which is a base material, and a conducting elastic material (e.g., EPDM, a urethane foam, or the like) which covers a surface of the metal shaft. The conducting elastic material makes it possible to uniformly apply the high voltages to the intermediate transfer belt 61. Although a roller-shaped transfer electrode is employed in the present embodiment, the present embodiment is not limited to this. Alternatively, a brush-shaped transfer electrode etc. can be employed.

Toner images formed on the photoreceptor drums 3, which toner images are developed from electrostatic latent images by use of the toners having respective colors are stacked on the intermediate transfer belt 61. A multicolor toner image thus formed is moved, by rotation of the intermediate transfer belt 61, to a position where a sheet of recording paper and the intermediate transfer belt 61 come into contact with each other, i.e., moved to the second transfer section, so that the multicolor toner image is transferred onto the sheet of recording paper by the second transfer roller 66 provided in the second transfer section. In the second transfer section, the second transfer roller 66 faces the intermediate transfer tension roller 64 across the intermediate transfer belt 61.

In the second transfer section, the intermediate transfer belt 61 and the second transfer roller 66 are pressed against each other in a predetermined nip area. A voltage (high voltage having a polarity (+) opposite to a polarity (−) of the toners) is applied to the second transfer roller 66 so that toners are transferred onto a sheet of recording paper. In order that the predetermined nip area is steadily secured, one of the second transfer roller 66 and the intermediate transfer tension roller 64 is made from a hard material (a metal or the like) and the other is made from a soft material (e.g., an elastic rubber roller, a foaming resin roller, or the like) such as an elastic roller.

The intermediate transfer belt 61 comes into contact with the photoreceptor drums 3 so that the toners adhere to the intermediate transfer belt 61. The toners on the intermediate transfer belt 61 are not entirely transferred onto a sheet of recording paper by the second transfer roller 66. As a result, some toners remain on the intermediate transfer belt 61. Such remaining toners can cause toner mixture in a next step. Accordingly, the belt cleaning unit 10 removes and collects such remaining toners. The belt cleaning unit 10 includes, e.g., a cleaning blade as a cleaning member which has contact with the intermediate transfer belt 61. In a position where the cleaning blade has contact with the intermediate transfer belt 61, the intermediate transfer belt 61 is supported, from its back side, by the intermediate transfer belt driven roller 63.

The internal paper feeding section 114 includes a paper feeding cassette 81. The paper feeding cassette 81 houses sheets (sheets of recording paper) on which images are formed, and supplies a sheet in response to a paper feeding request.

The manual paper feeding section 113 includes a manual paper feeding tray 82. Sheets on which images are formed are set on the manual paper feeding tray 82. The manual paper feeding section 113 supplies a sheet in response to a paper feeding request, as is the case with the internal paper feeding section 114.

A sheet supplied from the internal paper feeding section 114 or the manual paper feeding section 113 is carried to the second transfer section where a multicolor toner image is transferred onto the sheet, and then, the sheet is carried to the fixing unit 7. The fixing unit 7 fixes, onto the sheet, the multicolor toner image transferred onto the sheet. Then, the sheet is outputted onto the paper output tray 91 face down.

A plurality of carrying rollers 12 and a plurality of registration rollers 13 are provided on a paper carrying path which extends from each of the internal paper feeding section 114 and the manual paper feeding section 113 to the paper output tray 91.

Further, photosensors (density sensors) 101 are provided so as to face an upper surface of the intermediate transfer belt 61, in a position adjacent to the image forming section 112 corresponding to black, downstream from the image forming section 112 with respect to the moving direction of the intermediate transfer belt 61, which image forming section 112 is an endmost image forming section 112 on a downstream side among the four image forming sections 112. The photosensors 101 are used in the process control. Each of the photosensors 10 measures a density of a toner image (toner patch) transferred onto the intermediate transfer belt 61. According to the present embodiment, the photosensors 101 are provided in a position corresponding to one roller provided downstream from the endmost image forming section 112 on the downstream side, i.e., provided in a position corresponding to the intermediate transfer belt driving roller 62.

Further, according to the present embodiment, two photosensors 101 are provided along a width direction of the intermediate transfer belt 61.

A temperature-humidity sensor 102 for measuring a temperature and a humidity in the vicinity of the image forming apparatus 100 is provided on a back surface of the manual paper feeding tray 82. Note that where to provide the temperature-humidity sensor 102 is not limited to this. That is, the temperature-humidity sensor 102 can be provided in the vicinity of the image forming apparatus 100 or inside the image forming apparatus 100.

Figure 2:
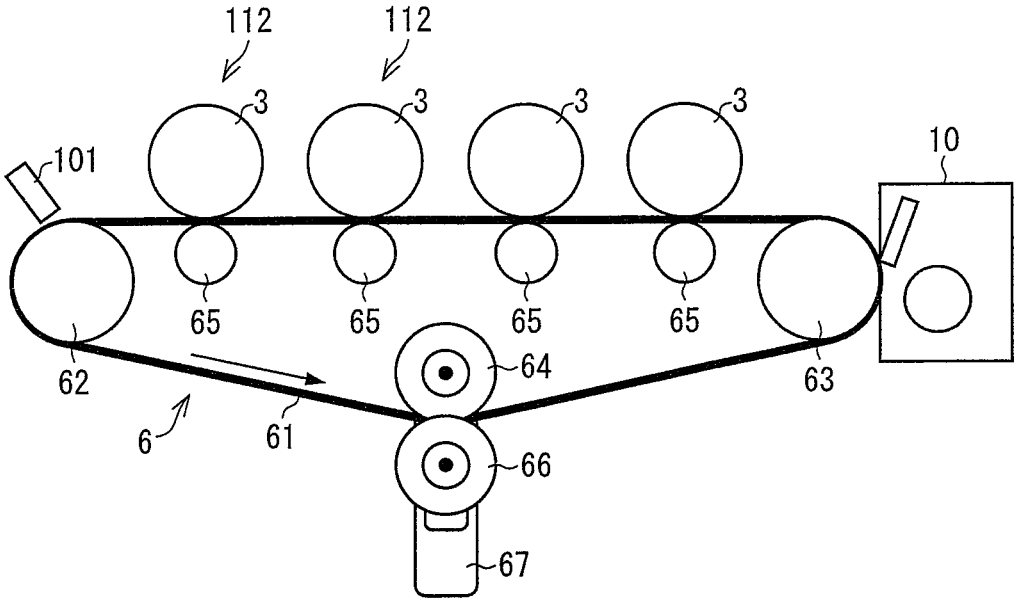
FIG. 2(*a*) is a schematic view illustrating an intermediate transfer belt unit illustrated in FIG. 1 in a state in which the second transfer roller is pressed against the intermediate transfer belt.
Figure 2:
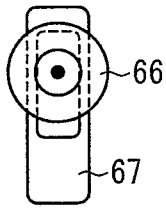

FIG. 2(*a*) is a schematic view illustrating the intermediate transfer belt unit 6 illustrated in FIG. 1 in a state in which the second transfer roller 66 is pressed against the intermediate transfer belt 61. FIG. 2(*b*) is an explanatory view illustrating a positional relationship between the second transfer roller 66 and a second transfer roller supporting member 67 in a state illustrated in FIG. 2(*a*).

Figure 3:
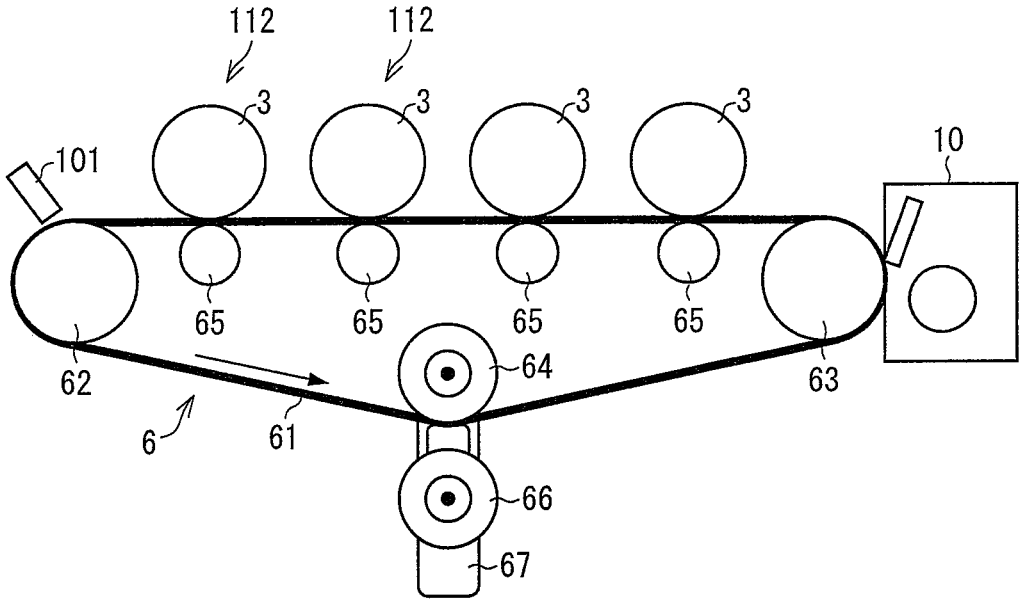
FIG. 3(*a*) is a schematic view illustrating the intermediate transfer belt unit illustrated in FIG. 1 in a state in which the second transfer roller is detached from the intermediate transfer belt.
Figure 3:
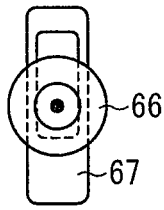

FIG. 3(*a*) is a schematic view illustrating the intermediate transfer belt unit 6 illustrated in FIG. 1 in a state in which the second transfer roller 66 is detached from the intermediate transfer belt 61. FIG. 3(*b*) is an explanatory view illustrating a positional relationship between the second transfer roller 66 and the second transfer roller supporting member 67 in a state illustrated in FIG. 3(*a*).

As illustrated in FIG. 2(*a*) and FIG. 3(*a*), the second transfer roller 66 is supported by the second transfer roller supporting member 67 so as to detach from and come into contact with the intermediate transfer belt 61. Specifically, in the second transfer section, the intermediate transfer belt 61 is supported, from its back surface side, by the intermediate transfer tension roller 64. The second transfer roller 66 is vertically movable between a position where the second transfer roller 66 is pressed against the intermediate transfer belt 61 (contact position, see FIG. 2(*a*)) and a position where the second transfer roller 66 is detached from the intermediate transfer belt 61 (detached position, see FIG. 3(*a*)). The second transfer roller 66 is moved between the contact position and the detached position by a second transfer roller moving apparatus (transfer roller moving means). The second transfer roller moving apparatus includes a mechanism for vertically moving the second transfer roller 66, such as a solenoid or a cam mechanism.

Figure 4:
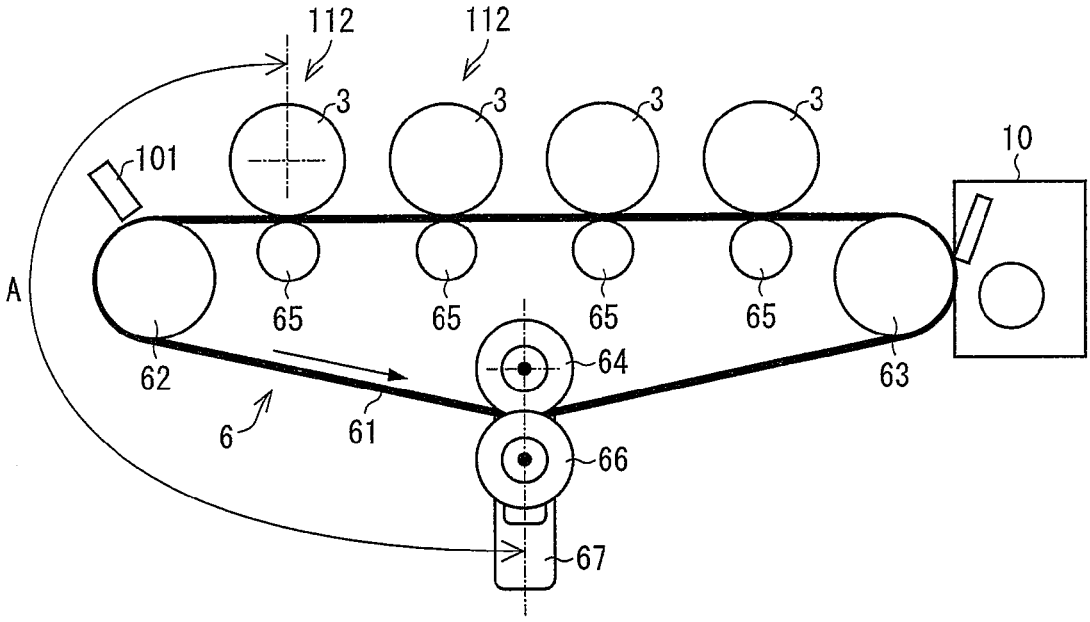
FIG. 4 is an explanatory view illustrating a length of the intermediate transfer belt of the image forming apparatus of FIG. 1 between a second transfer section (second transfer roller) and a photoreceptor drum of an endmost image forming unit on a downstream side with respect to a moving direction of the intermediate transfer belt.

According to the present embodiment, the image forming apparatus 100 is arranged such that a length A in FIG. 4 is 400 mm which length A is a length of the intermediate transfer belt 61 between the photoreceptor drum 3 of the endmost image forming section 112 on the downstream side and the second transfer section (second transfer roller 66).

Figure 5:
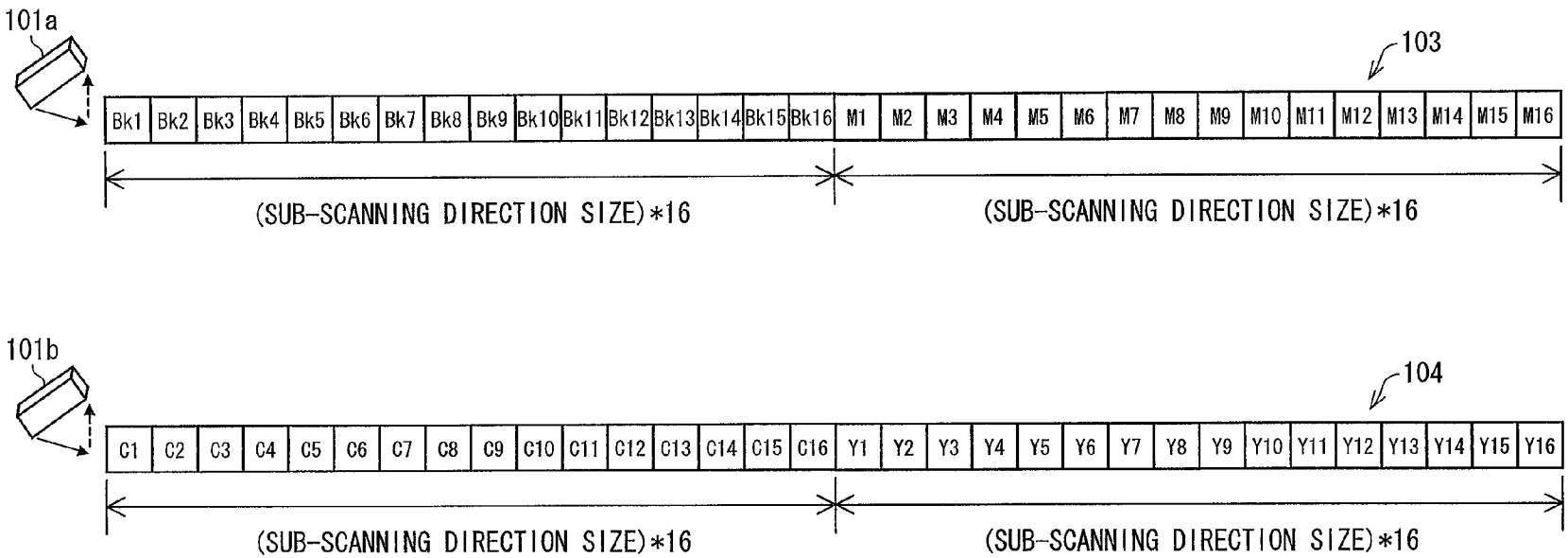
FIG. 5 is an explanatory view illustrating toner patches for process control formed on the intermediate transfer belt of FIG. 1.

FIG. 5 is an explanatory view showing how the toner patches (toners for image quality adjustment) for process control are formed on the intermediate transfer belt 61. The two photosensors 101 provided along the width direction of the intermediate transfer belt 61 are a first photosensor (density sensor) 101*a* and a second photosensor (density sensor) 101*b*.

The toner patches are formed in the following two rows, a first toner patch row (toner image row for image quality adjustment) 103 corresponding to the first photosensor 101*a* and a second toner patch row (toner image row for image quality adjustment) 104 corresponding to the second photosensor 101*b*. In the first toner patch row 103, a row of black toner patches and a row of magenta toner patches form one row. In the second toner patch row 104, a row of cyan toner patches and a row of yellow toner patches form one row. Each of the toner patches forms a 10×10-mm regular square. In each of the first toner patch row 103 and the second toner patch row 104, toner patches contiguously form a column.

Accordingly, the image forming apparatus 100 of the present embodiment is arranged such that a length of each of toner patch rows to be formed on the intermediate transfer belt 61 in the process control is 320 mm. In other words, each of the first toner patch row 103 and the second toner patch row 104 has a length of 320 mm, and is formed in a same position on the intermediate transfer belt 61 with respect to the moving direction of the intermediate transfer belt 61. The length (320 mm) of each of the first toner patch row 103 and the second toner patch row 104 is determined so as to be shorter than the length A (400 mm) which is a length of the intermediate transfer belt 61 between the photoreceptor drum 3 of the endmost image forming section 112 on the downstream side and the second transfer section (second transfer roller 66).

The number of toner patch rows for process control is not limited to 2 which has been employed above. Instead, the number of the toner patch rows can be 1 or not less than 3. In this case, the photosensors 101 are provided as many as the toner patch rows.

Figures 6, 7:
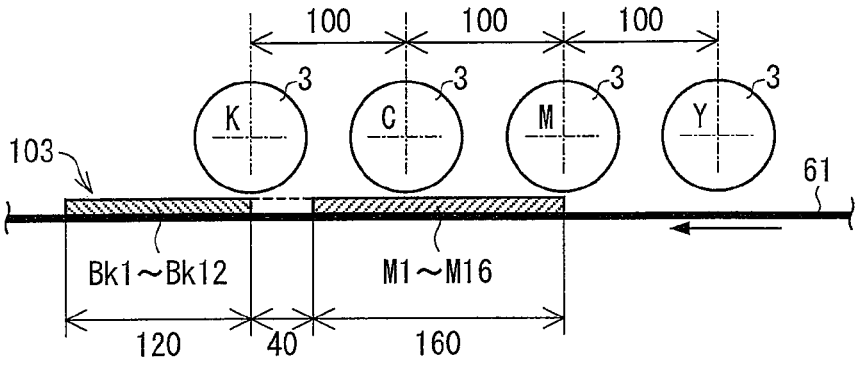
FIG. 6 is an explanatory view illustrating a procedure for forming a first toner patch row of FIG. 5.
FIG. 7 is an explanatory view showing speeds at which the first and second toner patch rows of FIG. 5 are formed by a plurality of image forming apparatuses which differ in printing speeds.

The following describes a procedure for forming, e.g., the first toner patch row 103 in FIG. 5. FIG. 6 is an explanatory view illustrating the procedure for forming the first toner patch row 103 in FIG. 5.

In a case where the first toner patch row 103 is formed, a magenta toner patch row (M1 to M16) is first formed as illustrated in FIG. 6, by the image forming section 112 corresponding to magenta which image forming section 112 is provided upstream from the image forming section 112 corresponding to black. The magenta toner patch row (M1 to M16) has a length of 160 mm. A distance between the photoreceptor drum 3 corresponding to magenta and the photoreceptor drum 3 corresponding to black is 200 mm. Accordingly, formation of the black toner patch row (Bk1 to Bk16) is started upon completion of formation of magenta toner patches M1 to M4 (40 mm in total) in the magenta toner patch row.

FIG. 6 illustrates a state in which the formation of the magenta toner patch row (M1 to M16) has been completed. In this state, black toner patches Bk1 to Bk12 in the black toner patch row have been formed. Then, black toner patches Bk13 to bk16 in the black toner patch row are formed. Thus, the formation of the first toner patch row 103 is completed in which the black toner patch row (Bk1 to Bk16) and the magenta toner patch row (M1 to M16) are connected.

The second toner patch row 104 is formed in the same manner as the formation of the first toner patch row 103. However, respective head positions of the first toner patch row 103 and the second toner patch row 104 are determined so as to coincide with each other with respect to the moving direction of the intermediate transfer belt 61.

FIG. 7 shows a formation speed (patch speed) of the first toner patch row 103 and the second toner patch row 104, with respect to each of a plurality of image forming apparatuses 100 which differ in printing speed. For example, "A4 10-sheet apparatus" indicates that a printing speed is 10 A4-size sheets of recording paper per minute. Formation speeds were measured under the following conditions. A size of one toner patch was 10 mm×10 mm, the number of toner patches in each of the first toner patch row 103 and the second toner patch row 104 was 32 (16+16), and a length of each of the first toner patch row 103 and the second toner patch row 104 was 320 mm.

Figure 8:
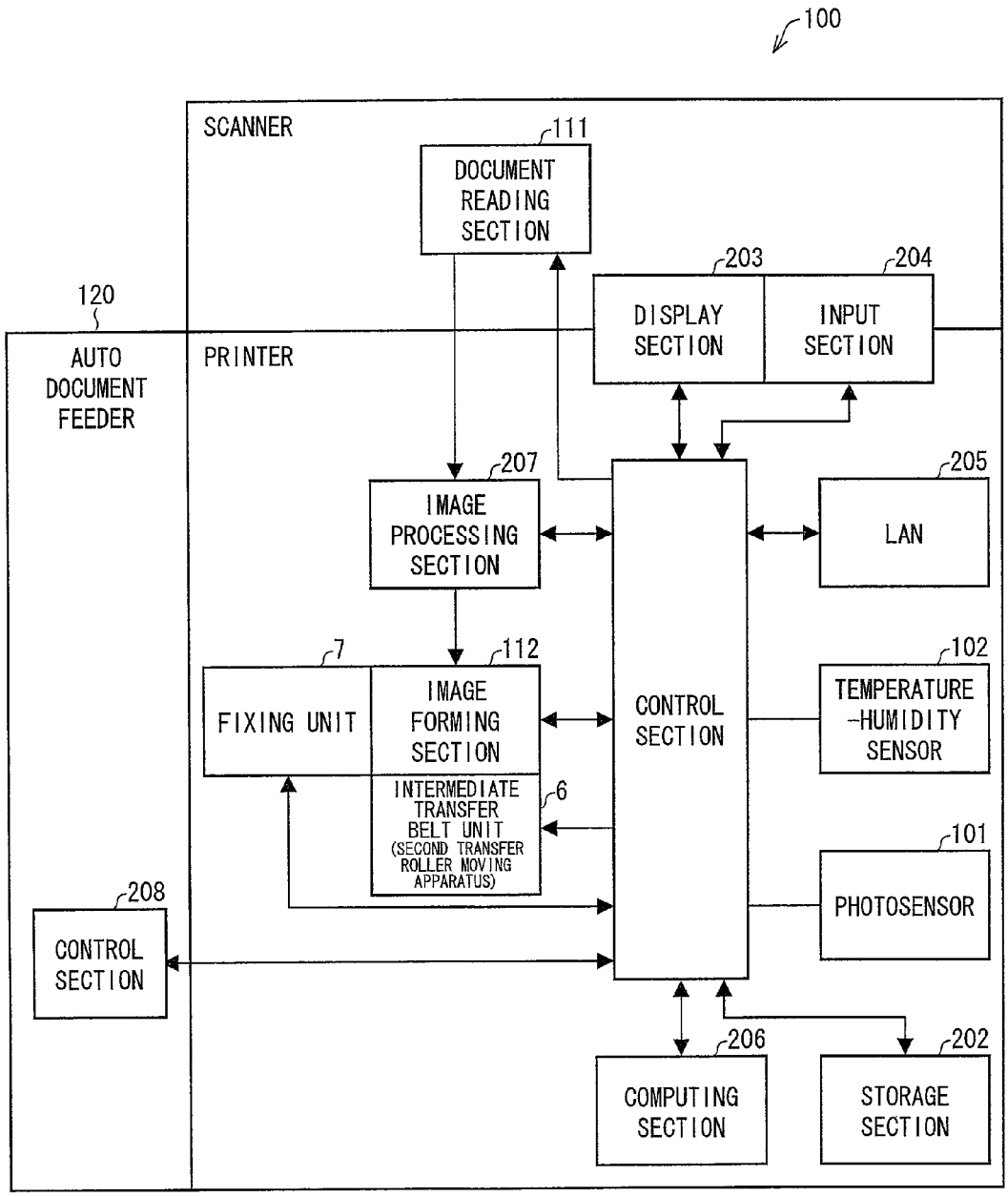
FIG. 8 is a block diagram illustrating an arrangement of the image forming apparatus of FIG. 1.

FIG. 8 is a block diagram illustrating an arrangement of the image forming apparatus 100.

As illustrated in FIG. 8, the image forming apparatus 100 includes a control section (control means) 201, a storage section 202, a display section 203, an input section 204, a LAN 205, a computing section 206, and an image processing section 207. The image forming apparatus 100 further includes the intermediate transfer belt unit 6, the fixing unit 7, the document reading section 111, the image forming section 112, the automatic document feeder 120 having a control section 208, the photosensors 101, and the temperature-humidity sensor 102. The intermediate transfer belt unit 6 includes the second transfer roller moving apparatus for moving the second transfer roller 66 between the contact position and the detached position.

The control section 201 controls each of sections of the image forming apparatus 100. For example, the control section 201 transmits a control signal to a target section in accordance with various determinations, a computational result, or the like supplied from the computing section 206, thereby controlling operation of the target section. For example, the control section 201 carries out the process control for image quality adjustment in a case where a change in at least any one of a temperature and a humidity which have been measured by the temperature-humidity sensor 102 exceeds a threshold, or in a case where the number of printed sheets exceeds a predetermined number. The number of printed sheets is counted by, e.g., the control section 201.

Each of the control section 201 and the computing section 206 is, e.g., a processing circuit realized by employment of a microcomputer, a microprocessor, or the like having a central processing unit (CPU).

The storage section 202 stores (i) a printing instruction supplied via an operation panel (display section 203, input section 204) provided on the upper surface of the image forming apparatus 100, (ii) detection results supplied from various sensors etc. (not illustrated) provided inside the image forming apparatus 100, and (iii) image information supplied from an external device via a LAN, a USB, or the like. The storage section 202 further stores various setting values and a data table which are used for controlling operation of each of internal sections of the image forming apparatus 100, and a program etc. for carrying out various control processes.

The storage section 202 can be a storage device which is commonly employed in this field, such as a read only memory (ROM), a random access memory (RAM), or a hard disk drive (HDD).

The external device is an electronic device which is capable of generating or obtaining image information and which is electrically connectable with the image forming apparatus 100. Specifically, the external device can be a computer, a digital camera, or the like.

The LAN 205 is a communications network which allows the image forming apparatus 100 to communicate with the external device. Specifically, the LAN 205 is a communications network such as an infrared communications network, a wireless LAN, a WiMAX, a mobile communications network, or another wireless or wired communications network.

The computing section 206 retrieves various data (printing instruction, detection result, image information, etc.) and a program for carrying out various control processes which various data and program are stored in the storage section 202, in order to carry out various detection processes and various determination processes.

The following describes how the image forming apparatus 100 thus arranged operates so as to carry out the process control.

The image forming apparatus 100 of the present embodiment is arranged such that a length of each of the toner patch rows to be formed on the intermediate transfer belt 61 in the process control is 320 mm. In other words, each of the first toner patch row 103 and the second toner patch row 104 has a length of 320 mm, and is formed in a same position on the intermediate transfer belt 61 with respect to the moving direction of the intermediate transfer belt 61. Further, the image forming apparatus 100 is arranged such that a length of the intermediate transfer belt 61 is 400 mm between the photoreceptor drum 3 of the endmost image forming section 112 on the downstream side and the second transfer section (second transfer roller 66).

That is, the length of the intermediate transfer belt 61 between the photoreceptor drum 3 of the endmost image forming section 112 on the downstream side and the second transfer section (second transfer roller 66) is longer than the length of each of the toner patch rows (the first toner patch row 103 and the second toner patch row 104) to be formed on the intermediate transfer belt 61. Accordingly, respective heads of the toner patch rows (the first toner patch row 103 and the second toner patch row 104) reach the second transfer section (second transfer roller 66) after the first photosensor

101*a* and the second photosensor 101*b* read the toner patch rows on the intermediate transfer belt 61 while the intermediate transfer belt 61 is moved.

Figure 9:
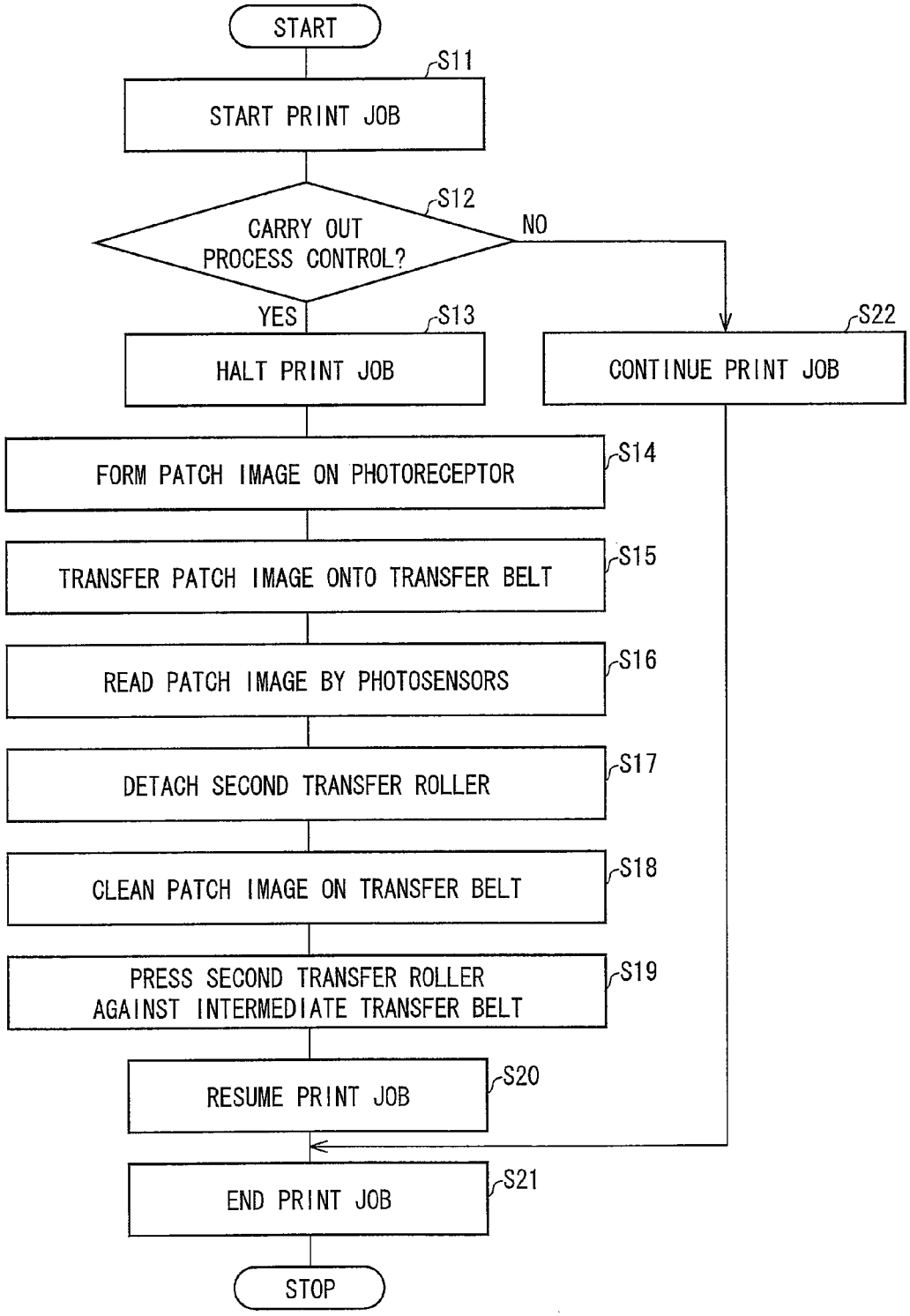
FIG. 9 is a flowchart showing how the image forming apparatus of FIG. 1 operates so as to carry out the process control.

FIG. 9 is a flowchart showing how the image forming apparatus 100 operates so as to carry out the process control.

As shown in FIG. 9, first, a print job is started in which printing on a plurality of sheets is carried out (S11). Then the control section 201 determines whether or not it is necessary to carry out the process control (S12). Determination in S12 is carried out on the basis of (i) whether or not there is an environmental change and (ii) the number of printed sheets. Specifically, in a case where a change in at least any one of a temperature and a humidity which have been measured by the temperature-humidity sensor 102 exceeds a threshold, or in a case where the number of printed sheets exceeds a predetermined number, the control section 201 determines that it is necessary to carry out the process control. In other cases, the control section 201 determines that it is not necessary to carry out the process control.

If NO in S12, the print job is continued (S22). After the print job is completed, the processing is ended.

If YES in S12, the print job is halted (S13). In a case where printing is still being carried out with respect to one sheet, the print job is halted in S13 after the printing is completed.

Then, the toner patches are formed on the photoreceptor drums 3 (S14). The toner patches are transferred onto the intermediate transfer belt 61 (S15). Thus, the first toner patch row 103 and the second toner patch row 104 in FIG. 5 are formed on the intermediate transfer belt 61.

Then, the first photosensor 101*a* and the second photosensor 101*b* read the first toner patch row 103 and the second toner patch row 104, respectively (S16). The image quality adjustment of the image forming apparatus 100 is carried out on the basis of reading results thus obtained by the first photosensor 101*a* and the second photosensor 101*b*. Specifically, e.g., voltages to be applied to the chargers 5 and an output value of a light source of the exposure unit 1 are adjusted.

After the first photosensor 101*a* and the second photosensor 101*b* read the first toner patch row 103 and the second toner patch row 104, the second transfer roller moving apparatus is caused to operate so as to detach the second transfer roller 66 from the intermediate transfer belt 61 (S17). S17 is carried out in order that a toner blot on the second transfer roller 66 is prevented, since the second transfer roller 66 does not have any cleaning mechanism. The toner blot is caused in such a manner that toners of the first toner patch row 103 and the second toner patch row 104 on the intermediate transfer belt 61 adhere to the second transfer roller 66.

The first toner patch row 103 and the second toner patch row 104 on the intermediate transfer belt 61 are passed through the second transfer section by movement of the intermediate transfer belt 61. Then, the first toner patch row 103 and the second toner patch row 104 are removed by the belt cleaning unit 10 (S18).

After the first toner patch row 103 and the second toner patch row 104 are passed through the second transfer section, the second transfer roller 66 is pressed against the intermediate transfer belt 61 (S19).

Then, the print job under the printing instruction is resumed (S20). After the print job is completed (S21), the processing is ended.

As describe above, the second transfer roller 66 is pressed against the intermediate transfer belt 61 during a print job so as to sequentially transfer, onto sheets of recording paper in the second transfer section, toner images which have been sequentially transferred from the photoreceptor drums 3 onto the intermediate transfer belt 61. In a case where the process control is carried out in a print job, the first toner patch row 103 and the second toner patch row 104 are formed on the intermediate transfer belt 61, and the first photosensor 101*a* and the second photosensor 101*b* read the first toner patch row 103 and the second toner patch row 104, respectively, while the second transfer roller 66 is pressed against the intermediate transfer belt 61.

This makes it possible to swiftly form the first toner patch row 103 and the second toner patch row 104 on the intermediate transfer belt 61 in the process control after a print job is halted.

Further, the second transfer roller 66 is not detached from nor brought into contact with the intermediate transfer belt 61 while the first toner patch row 103 and the second toner patch row 104 are formed on the intermediate transfer belt 61 and while the first toner patch row 103 and the second toner patch row 104 are read by the first photosensor 101*a* and the second photosensor 101*b*, respectively. Accordingly, the intermediate transfer belt 61 is not shaken by such detachment movement nor contact movement of the second transfer roller 66. This makes it possible to carry out, accurately and stably, formation of the first toner patch row 103 and the second toner patch row 104 on the intermediate transfer belt 61 and reading of the first toner patch row 103 and the second toner patch row 104 by the first photosensor 101*a* and the second photosensor 101*b*. As a result, the process control can be carried out accurately.

According to the present embodiment, (i) the first toner patch row 103 and the second toner patch row 104 are formed on the intermediate transfer belt 61, then (ii) the first toner patch row 103 and the second toner patch row 104 are read by the first photosensor 101*a* and the second photosensor 101*b*, and finally (iii) the second transfer roller is detached from the intermediate transfer belt 61. However, in a case where a length of each of the first toner patch row 103 and the second toner patch row 104 is greater than a length of the intermediate transfer belt 61 between the second transfer roller 66, and the first photosensor 101*a* and the second photosensor 101*b*, the second transfer roller 66 is detached from the intermediate transfer belt 61 while the first toner patch row 103 and the second toner patch row 104 are read by the first photosensor 101*a* and the second photosensor 101*b*, respectively, before the first toner patch row 103 and the second toner patch row 104 reach the second transfer roller 66.

Even if the second transfer roller 66 is thus detached from the intermediate transfer belt 61, shaking of the intermediate transfer belt 61 which shaking is caused by such movement has a small effect on reading results which are obtained by the first photosensor 101*a* and the second photosensor 101*b*.

On the other hand, the second transfer roller 66 is not detached from nor brought into contact with the intermediate transfer belt 61 while the first toner patch row 103 and the second toner patch row 104 are formed on the intermediate transfer belt 61. This makes it possible to accurately form the first toner patch row 103 and the second toner patch row 104 on the intermediate transfer belt 61, and to accurately carry out the process control on the basis of the reading results that the first photosensor 101*a* and the second photosensor 101*b* have obtained by reading the first toner patch row 103 and the second toner patch row 104.

Figure 10:
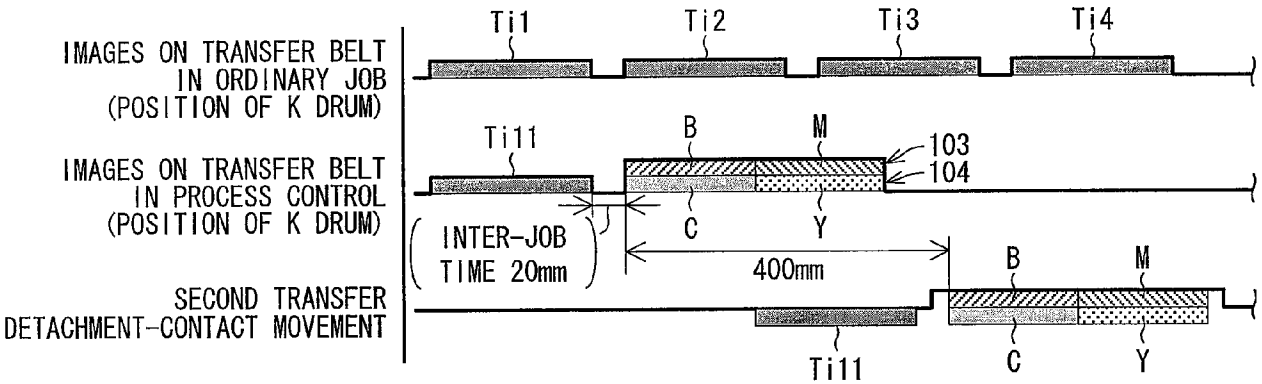
FIG. 10(*a*) is a timing chart illustrating the process control of the image forming apparatus of FIG. 1.
Figure 10:
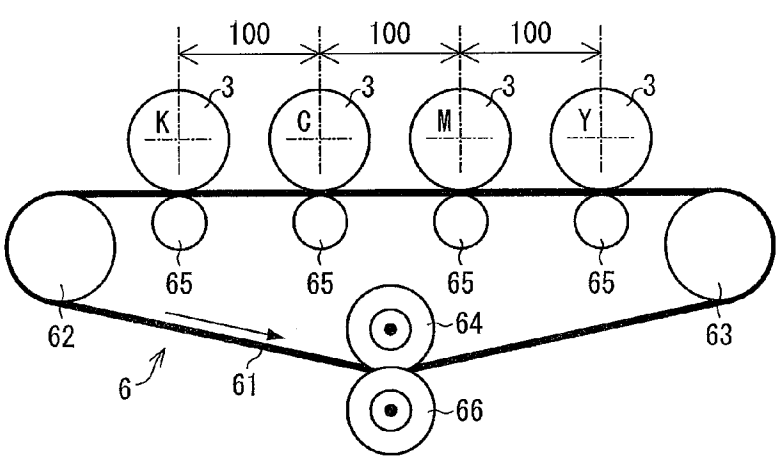
Figure 11:
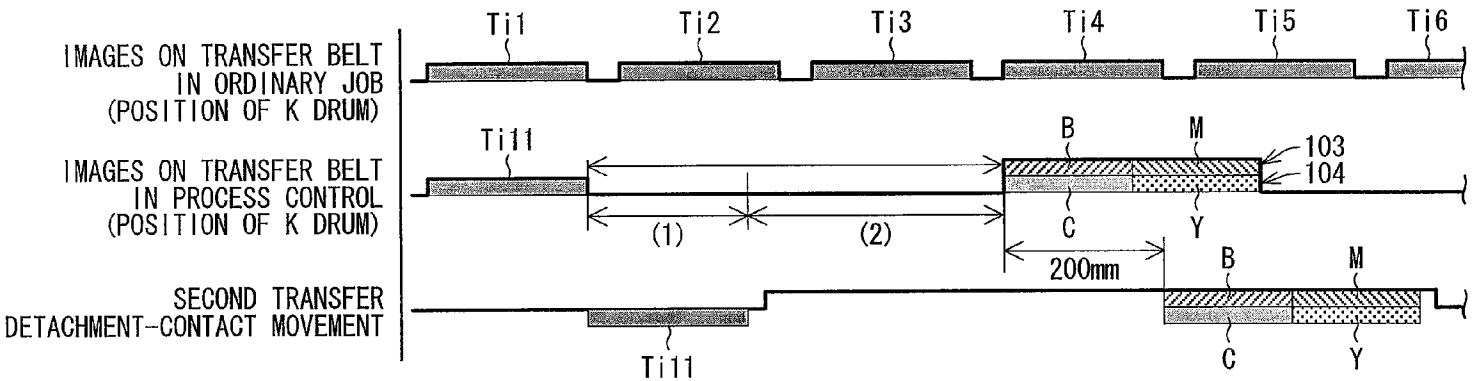
FIG. 11(*a*) is a timing chart illustrating the process control of a conventional image forming apparatus.
Figure 11:
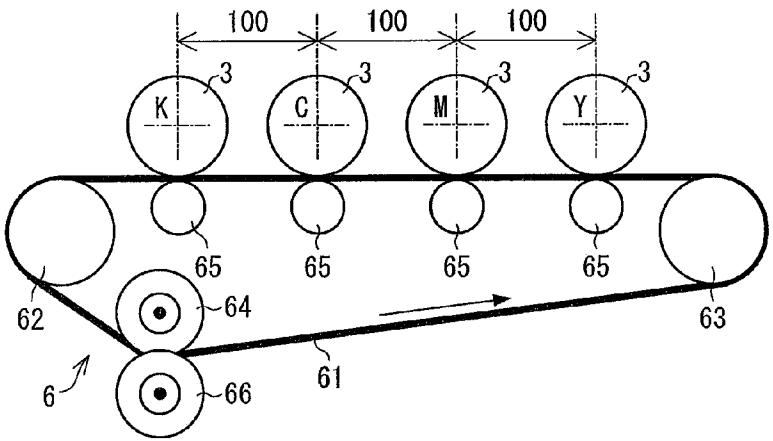

The following describes results of comparison between the image forming apparatus 100 of the present embodiment and a conventional image forming apparatus. FIG. 10(*a*) is a timing chart illustrating the process control of the image forming apparatus 100 of the present embodiment. FIG. 10(*b*) is an explanatory view illustrating a positional relationship between the photoreceptor drums 3 and the second transfer section (second transfer roller 66) in the image forming apparatus 100. FIG. 11(*a*) is a timing chart illustrating the process control of the conventional image forming apparatus. FIG. 11(*b*) is an explanatory view illustrating a positional relationship between the photoreceptor drums 3 and the second transfer section (second transfer roller 66) in the conventional image forming apparatus.

In FIG. 10(*b*) for the image forming apparatus 100 of the present embodiment, a distance between any two adjacent photoreceptor drums 3 is 300 mm, a length of each of the toner patch rows is 320 mm, a length of the intermediate transfer belt 61 between an endmost photoreceptor drum (K) 3 on the downstream side and the second transfer section is 400 mm (toner patch row length<intermediate transfer belt length between endmost photoreceptor drum (K) 3 and second transfer section).

In FIG. 11(*b*) for the conventional image forming apparatus, a distance between any two adjacent photoreceptor drums 3 is 300 mm, and a length of each of the toner patch rows is 320 mm. Although this is the same as the image forming apparatus 100, a length of the intermediate transfer belt 61 between the endmost photoreceptor drum (K) 3 on the downstream side and the second transfer section is 200 mm (toner patch row length>intermediate transfer belt length between endmost photoreceptor drum (K) 3 and second transfer section).

In each of FIG. 10(*a*) and FIG. 11(*a*), a top chart line indicates timings when toner images (normal job transfer belt images Ti1, Ti2, Ti3, . . . ) are sequentially formed on the intermediate transfer belt 61 in an ordinary print job. A middle chart line indicates timings when the first toner patch row 103 and the second toner patch row 104 (process control transfer belt images) are formed on the intermediate transfer belt 61 after one image is formed on the intermediate transfer belt 61 in the normal print job. A bottom chart line indicates timings when the second transfer roller 66 is detached from and brought into contact with the intermediate transfer belt 61 (second transfer detachment-contact movement). In the second transfer detachment-contact movement, the second transfer roller 66 is detached from the intermediate transfer belt 61 after a toner image Ti11 is transferred from the intermediate transfer belt 61 onto a sheet of recording paper.

The following compares (i) the timing when the process control transfer belt images are formed which timing is illustrated in FIG. 10(*a*) for the image forming apparatus 100 of the present embodiment and (ii) the timing when the process control transfer belt images are formed which timing is illustrated in FIG. 11(*a*) for the conventional image forming apparatus. According to FIG. 10(*a*), transition from completion of formation of the toner image Ti11 to initiation of formation of the first toner patch row 103 and the second toner patch row 104 is swiftly carried out on the intermediate transfer belt 61. In contrast, according to FIG. 11(*a*), transition from completion of formation of the toner image Ti11 to initiation of formation of the first toner patch row 103 and the second toner patch row 104 takes time on the intermediate transfer belt 61 considerably longer than that of FIG. 10(*a*).

This is because since the conventional image forming apparatus is arranged so that "toner patch row length>intermediate transfer belt length between endmost photoreceptor drum (K) 3 and second transfer section," it is necessary to secure, before the first toner patch row 103 and the second toner patch row 104 are formed on the intermediate transfer belt 61, (i) a time for transferring the toner image Ti11 from the intermediate transfer belt 61 onto a sheet of recording paper and (ii) a time for (a) detaching the second transfer roller 66 from the intermediate transfer belt 61 in advance and (b) dampening shaking of the intermediate transfer belt 61 thus caused.

With respect to each of a case of FIG. 10(*a*) and a case of FIG. 11(*a*), the following describes a time for transition from a print job to toner patch row formation, i.e., describes a concrete example of a time from the completion of formation of the toner image Ti11 to the initiation of formation of the first toner patch row 103 and the second toner patch row 104. In the following, the time for transition from the print job to the toner patch row formation is represented by a moving distance of the intermediate transfer belt 61.

In the case of FIG. 10(*a*), the time for transition corresponds to 20 mm. In contrast, in the case of FIG. 11(*a*), the time for transition corresponds to 520 mm. The 20 mm is an inter-job distance. On the other hand, a breakdown of the 520 mm is expressed as 300 mm (inter-photoreceptor distance)+200 mm (length of intermediate transfer belt 61 from endmost photoreceptor drum (K) 3 on downstream side to second transfer section)+20 mm (inter-job distance=second transfer detachment-contact movement time).

FIG. 12 shows times for transition from a print job to toner patch row formation, with respect to each of a plurality of image forming apparatuses 100 which differ in printing speed. In FIG. 12, a column having a table heading of "conventional time" shows times for transition which were obtained in a case where each of the times corresponds to 540 mm, and a column having a table heading of "time of present invention" shows times for transition which were obtained in a case where each of the times corresponds to 40 mm.

As shown in FIG. 12, image forming apparatuses 100 according to the present embodiment make it possible to considerably reduce a time for transition from a print job to toner patch row formation, as compared to conventional image forming apparatuses. This makes it possible to surely suppress a decrease in processing speed of a print job even if the process control is carried out at a certain point in a print job.

As described above, the image forming apparatus may be arranged such that the at least one toner image row has a length greater than a distance between an endmost one of the respective photoreceptor drums on an upstream side of the outward path and the endmost one of the respective photoreceptor drums on the downstream side of the outward path.

For accurate image quality adjustment, many toner images for image quality adjustment are formed, with respect to each of different colors, so as to have densities which are gradually changed. In addition, a length of at least one toner image row for image quality adjustment is greater than a distance between an endmost photoreceptor drum on an upstream side with respect to a moving direction of an intermediate transfer belt and an endmost photoreceptor drum on a downstream side with respect to the moving direction. Even in such a case, there is no need to wait, before image quality adjustment is carried out, for a time for (i) detaching the transfer roller from the intermediate transfer belt and (ii) dampening shaking of the intermediate transfer belt thus caused, in a case where the length of each of the at least one toner image row for image quality adjustment is arranged to be shorter than a length of the intermediate transfer belt between the endmost photoreceptor drum on the downstream side and the transfer roller. This makes it possible to suppress a decrease in processing speed of a print job.

The image forming apparatus may be arranged such that: the at least one toner image row for image quality adjustment is a plurality of toner image rows for image quality adjustment; said at least one density sensor being provided so as to respectively correspond to the plurality of toner image rows; and a length of each of the plurality of toner image rows between its head position and its tail position along a rotation direction of the intermediate transfer belt is smaller than a length of the intermediate transfer belt between said transfer roller and the endmost one of the respective photoreceptor drums on the downstream side of the outward path.

According to the arrangement, a plurality of toner image rows for image quality adjustment are formed. Accordingly, even if many toner images for image quality adjustment are formed for accurate image quality adjustment, it is possible to set a length of each of the toner image rows for image quality adjustment so that the length is smaller than a length of the intermediate transfer belt between said transfer roller and the endmost one of the respective photoreceptor drums on the downstream side of the outward path.

The image forming apparatus may be arranged such that: the image forming sections correspond to four colors, yellow, magenta, cyan, and black, respectively; the at least one toner image row for image quality adjustment are two rows which are (i) a first toner image row made up of two toner image rows for image quality adjustment which two toner image rows correspond respectively to any two of the four colors and (ii) a second toner image row made up of two toner image rows for image quality adjustment which two toner image rows correspond respectively to other two of the four colors; the first toner image row and the second toner image row have a same length; a head position and a tail position of the first toner image row and a head position and a tail position of the second toner image row coincide with each other with respect to a rotation direction of the intermediate transfer belt, respectively; and said at least one density sensor is provided so as to correspond respectively to the first toner image row and the second toner image row.

According to the arrangement, two toner image rows for image quality adjustment are formed. Therefore, in an arrangement in which the four image forming sections are provided which correspond to the four colors, yellow, magenta, cyan, and black, it is possible to set a length of each of the toner image rows for image quality adjustment so that the length is smaller than a length of the intermediate transfer belt between said transfer roller and the endmost one of the respective photoreceptor drums on the downstream side of the outward path, even if many toner images for image quality adjustment are formed for accurate image quality adjustment.

The image forming apparatus may be arranged such that transfer roller moving means for moving said transfer roller to the contact position or to the detachment position is provided; control means for controlling operation of the transfer roller moving means is provided; in a case where the printing operation has been switched to the image quality adjustment operation, the control means causes said transfer roller to be held at the contact position until said at least one density sensor completes reading of the at least one toner image row for image quality adjustment; and after said at least one density sensor completes the reading, the control means causes said transfer roller to move to the detachment position.

According to the arrangement, in a case where the printing operation has been switched to the image quality adjustment operation, the control means causes said transfer roller to be held at the contact position until the at least one density sensor completes reading of the at least one toner image row for image quality adjustment, and after the at least one density sensor completes the reading, the control means causes said transfer roller to move to the detachment position. This makes it possible to surely prevent from a transfer roller having no cleaning mechanism having a toner blot caused due to a toner image for image quality adjustment.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

REFERENCE SIGNS LIST

1 Exposure unit
3 Photoreceptor drum
5 Charger
6 Intermediate transfer belt unit
10 Belt cleaning unit
61 Intermediate transfer belt
62 Intermediate transfer belt driving roller
63 Intermediate transfer belt driven roller
64 Intermediate transfer tension roller
65 Intermediate transfer roller
66 Second transfer roller (transfer roller)
100 Image forming apparatus
101 Photosensor (density sensor)
101*a* First photosensor (density sensor)
101*b* Second photosensor (density sensor)
102 Temperature-humidity sensor
103 First toner patch row (toner image row for image quality adjustment)
104 Second toner patch row (toner image row for image quality adjustment)
110 Main apparatus
111 Document reading section
112 Image forming section
113 Manual paper feeding section
120 Automatic document feeder
201 Control section (control means)

The invention claimed is:

1. An image forming apparatus comprising:

an intermediate transfer belt being supported by a first roller and a second roller so as to be rotated in one direction, the intermediate transfer belt having, as a moving path of an outer surface of the intermediate transfer belt, an outward path extending from the first roller to the second roller and a returning path extending from the second roller to the first roller;

image forming sections corresponding to respective colors, the image forming sections having respective photoreceptor drums which face the outer surface of the intermediate transfer belt on the outward path, the image forming sections forming respective toner images on the respective photoreceptor drums, the image forming sections being arranged in a direction in which the outward path extends;

a transfer roller being provided in position on the returning path, the transfer roller which is moved to a contact position where the transfer roller is pressed against the outer surface of the intermediate transfer belt or to a detachment position where the transfer roller is detached from the outer surface; and at least one density sensor which measures a density of a toner image formed on the intermediate transfer belt, the at least one density sensor being provided between said transfer roller and an endmost one of the respective photoreceptor drums on a downstream side of the outward path;

a transfer roller moving means for moving said transfer roller to the contact position or to the detachment position; and a control means for controlling operation of the transfer roller moving means, wherein in a printing operation, the respective toner images formed on the respective photoreceptor drums being transferred onto the intermediate transfer belt so as to be superimposed, and while said transfer roller is in the contact position, a toner image thus formed on the intermediate transfer belt being transferred onto a sheet supplied between said transfer roller and the intermediate transfer belt, and in an image quality adjustment operation, said image forming sections forming, on the intermediate transfer belt, at least one toner image row for image quality adjustment, the at least one toner image row being a row of toner images for image quality adjustment, and said at least one density sensor measuring a density of each of the toner images for image quality adjustment in the at least one toner image row, the at least one toner image row having a length smaller than a length of the intermediate transfer belt between said transfer roller and the endmost one of the respective photoreceptor drums on the downstream side of the outward path, wherein in a case where the printing operation has been switched to the image quality adjustment operation, the control means causes said transfer roller to be held at the contact position until said at least one density sensor completes reading of the at least one toner image row for image quality adjustment; and after said at least one density sensor completes the reading, the control means causes said transfer roller to move to the detachment position.

2. The image forming apparatus as set forth in claim 1, wherein the at least one toner image row has a length greater than a distance between an endmost one of the respective photoreceptor drums on an upstream side of the outward path and the endmost one of the respective photoreceptor drums on the downstream side of the outward path.

3. The image forming apparatus as set forth in claim 1, wherein:

the at least one toner image row for image quality adjustment is a plurality of toner image rows for image quality adjustment;

said at least one density sensor being provided so as to respectively correspond to the plurality of toner image rows; and a length of each of the plurality of toner image rows between its head position and its tail position along a rotation direction of the intermediate transfer belt is smaller than a length of the intermediate transfer belt between said transfer roller and the endmost one of the respective photoreceptor drums on the downstream side of the outward path.

4. The image forming apparatus as set forth in claim 1, wherein a tension roller which applies a tension to the intermediate transfer belt from an inner surface side is provided in a position where the tension roller and said transfer roller face each other across the intermediate transfer belt.

5. The image forming apparatus as set forth in claim 1, wherein:

the image forming sections correspond to four colors, yellow, magenta, cyan, and black, respectively;

the at least one toner image row for image quality adjustment are two rows which are (i) a first toner image row made up of two toner image rows for image quality adjustment which two toner image rows correspond respectively to any two of the four colors and (ii) a second toner image row made up of two toner image rows for image quality adjustment which two toner image rows correspond respectively to other two of the four colors;

the first toner image row and the second toner image row have a same length;

a head position and a tail position of the first toner image row and a head position and a tail position of the second toner image row coincide with each other with respect to a rotation direction of the intermediate transfer belt, respectively; and said at least one density sensor is provided so as to correspond respectively to the first toner image row and the second toner image row.

6. The image forming apparatus as set forth in claim 5, wherein:

the image forming sections correspond to four colors, a first color, a second color, a third color, and a fourth color, respectively;

yellow, magenta, cyan, and black correspond to the four colors in any order;

the image forming sections are provided from the upstream side to the downstream side of the outward path in an order of the four colors; and the first toner image row for image quality adjustment is formed by two of the image forming sections which two correspond to the first color and the third color, and the second toner image row for image quality adjustment is formed by other two of the image forming sections which other two correspond to the second color and the fourth color.

7. An image forming method of an image forming apparatus, the image forming apparatus including:

an intermediate transfer belt being supported by a first roller and a second roller so as to be rotated in one direction, the intermediate transfer belt having, as a moving path of an outer surface of the intermediate transfer belt, an outward path extending from the first roller to the second roller and a returning path extending from the second roller to the first roller;

image forming sections corresponding to respective colors, the image forming sections having respective photoreceptor drums which face the outer surface of the intermediate transfer belt on the outward path, the image forming sections forming respective toner images on the respective photoreceptor drums, the image forming sections being arranged in a direction in which the outward path extends;

a transfer roller being provided in position on the returning path, the transfer roller which is moved to a contact position where the transfer roller is pressed against the outer surface of the intermediate transfer belt or to a detachment position where the transfer roller is detached from the outer surface; and at least one density sensor which measures a density of a toner image formed on the intermediate transfer belt, the at least one density sensor being provided between said transfer roller and an endmost one of the respective photoreceptor drums on a downstream side of the outward path;

a transfer roller moving means for moving said transfer roller to the contact position or to the detachment position;

a control means for controlling operation of the transfer roller moving means, wherein in a printing operation, the respective toner images formed on the respective photoreceptor drums being transferred onto the intermediate transfer belt so as to be superimposed, and while said transfer roller is in the contact position, a toner image thus formed on the intermediate transfer belt being transferred onto a sheet supplied between said transfer roller and the intermediate transfer belt, in an image quality adjustment operation, said image forming sections forming, on the intermediate transfer belt, at least one toner image row for image quality adjustment, the at least one toner image row being a row of toner images for image quality adjustment, and each of said at least one density sensor measuring a density of each of the toner images for image quality adjustment in the at least one toner image row, and wherein in a case where the printing operation has been switched to the image quality adjustment operation, the control means causes said transfer roller to be held at the contact position until said at least one density sensor completes reading of the at least one toner image row for image quality adjustment, and after said at least one density sensor completes the reading, the control means causes said transfer roller to move to the detachment position, the image forming method comprising the step of forming the at least one toner image row for image quality adjustment so that the at least one toner image row has a length smaller than a length of the intermediate transfer belt between said transfer roller and the endmost one of the respective photoreceptor drums on the downstream side of the outward path.

* * * * *